US006167730B1

(12) United States Patent
Willmer

(10) Patent No.: US 6,167,730 B1
(45) Date of Patent: Jan. 2, 2001

(54) SINKER AND SELECTOR ARRANGEMENT FOR A CIRCULAR KNITTING MACHINE

(75) Inventor: Rolf Willmer, Albstadt (DE)

(73) Assignee: SIPRA Patententwicklungs- u. Beteiligungsgesellschaft mbH, Albstadt (DE)

( * ) Notice: Under 35 U.S.C. 154(b), the term of this patent shall be extended for 0 days.

(21) Appl. No.: 09/314,356

(22) Filed: May 19, 1999

(30) Foreign Application Priority Data

May 22, 1998 (DE) ..... 198 22 861

(51) Int. Cl.[7] ..... D04B 15/06
(52) U.S. Cl. ..... 66/106; 66/217; 66/220
(58) Field of Search ..... 66/104, 106, 217, 66/220; 139/455

(56) References Cited

U.S. PATENT DOCUMENTS

| | | | | |
|---|---|---|---|---|
| 3,362,195 | * | 1/1968 | Goisis | 66/74 |
| 4,574,596 | * | 3/1986 | Engelfried et al. | 66/106 |
| 4,584,851 | * | 4/1986 | Plath | 66/104 |

FOREIGN PATENT DOCUMENTS

| | | | |
|---|---|---|---|
| 681 180 | | 9/1939 | (DE) . |
| 33 32 280 C2 | | 12/1985 | (DE) . |
| 0 712 952 | * | 5/1996 | (EP) . |
| 0 752 490 | * | 1/1997 | (EP) . |
| 1 477 890 | * | 6/1977 | (GB) . |
| 2 242 692 | * | 10/1991 | (GB) . |
| WO 97/34036 | * | 9/1997 | (WO) . |

* cited by examiner

*Primary Examiner*—Andy Falik
(74) *Attorney, Agent, or Firm*—Michael J. Striker

(57) ABSTRACT

A sinker (1) for a circular knitting machine contains a shaft (2) with a recess (11) in which a selection element (12) provided with a controllable raising butt (20) is mounted swivellably and can be swivelled to and fro between a position in which the raising butt (20) is retracted into the recess (11) and a position in which the raising butt (20) projects upwards over the upper side of the shaft (2). A spring (21), which can be attached to the selection element (12) or the shaft (2), serves to pre-tension the selection element (12) into one of these two positions (FIG. 1). In addition, a selection device is provided for selecting the sinker (1) in accordance with a pattern.

14 Claims, 5 Drawing Sheets

SINKER AND SELECTOR ARRANGEMENT FOR A CIRCULAR KNITTING MACHINE

Figure 1:
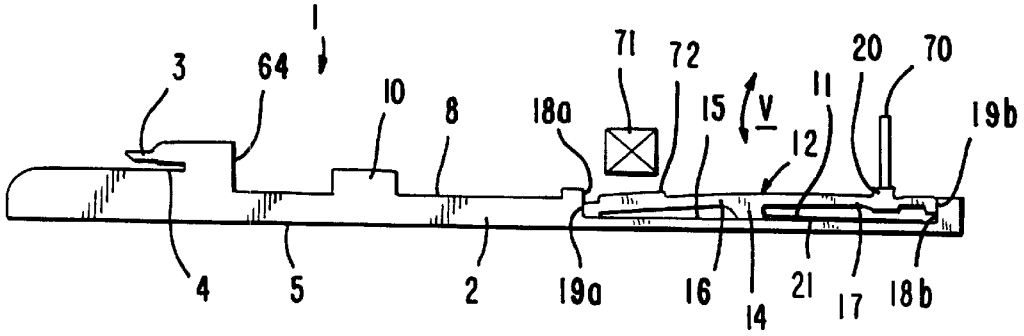

The invention relates to a sinker for a circular knitting machine and having a shaft which has an upper side and a back and which has a recess open towards the upper side.

Circular knitting machines for producing patterned knitwear frequently have a needle cylinder for receiving cylinder needles and a sinker ring assigned to the needle cylinder for receiving sinkers, especially holding-down sinkers and knockover sinkers. On account of the pattern, it can be desirable thereby to cause the needles and/or sinkers on individual or all of the knitting systems to carry out preselected movements with the help of mechanically, electrically or electromagnetically operating selection devices in order to thus control the knitting process. When producing plush goods it is known for example to move sinkers of the type mentioned at the beginning (DE-PS 681 180) back and forth in such a manner that a supplied plush thread is placed above high or low sinker edges. As a result, a plush fabric with plush loops at different heights can be produced or a plush fabric which consists of a two-thread basic knitted fabric which is provided at selected points with plush loops projecting over the knitted fabric. The selection both of the needles and also the sinkers results thereby with the help of selection devices in the form of mechanically operating pattern drums. Sinkers and selection devices of this type are unsuitable for fast-running, multi-system circular knitting machines really because of the mechanical pattern drums requiring a lot of space. In addition, the pattern options are limited.

In addition, plush sinkers are known (DE 33 32 280 C2) to which electromagnetic selection devices are assigned and which thus make possible practically any shape of pattern. The control of sinkers is achieved with the help of sinker jacks which are arranged parallel to the axis of the needle cylinder and which are arranged in the same needle channels of the needle cylinder as the cylinder needles. The sinker jacks can thereby be moved upwards and downwards under the control of the selection devices, said sinker jacks co-operating during the upwards stroke with wedge surfaces mounted on the undersides of the sinkers and consequently causing radial movements of the sinkers to occur perpendicular to their own axial movements. Sinker control systems of this type are however associated with increased friction and thus are undesirable. It is also inconvenient that the sinker jacks are arranged in the needle cylinder channels and hence can impair not only the function of the cylinder needles but also impede the application of selection devices for the cylinder needle if such additional selection devices are desired.

It is, therefore, an object of this invention to design the sinkers and selection devices mentioned above such that they are particularly useful for the tight spatial conditions in a sinker ring.

A further object of the invention is to design the sinkers and selection devices such that they can be operated with high reliability also under tight spatial conditions.

Yet a further object of the invention is to design the sinkers and selection devices such that they can be operated with high reliability and yet at high knitting speeds.

These and other objections of this invention are solved by a sinker having a selection element which is provided with a controllable raising butt and is arranged in the recess at least partly and in such a manner that it is mounted rotatably or swivellably relative to the shaft and can be swivelled into at least a first position, in which the raising butt is retracted behind the front side, and a second position in which the raising butt projects upwards over the upper side, wherein a spring pre-tensions the selection element into one of the two positions.

The invention further provides a selection device on a circular knitting machine containing: a sinker ring, sinkers, according to this invention being mounted displaceably in said sinker ring, a sinker cam assembly with cam parts operating on butts of the sinkers and an electromagnetic selection member which is arranged in the area of the selection point to distribute the sinkers onto different paths in accordance with a pattern, wherein said sinker cam assembly has a depressing cam part which swivels the selection elements into a position pre-tensioning the springs and as a result makes anchor surfaces of the selection elements approach the selection member.

Further advantageous features of the invention are claimed in the sub-claims.

Figure 2:
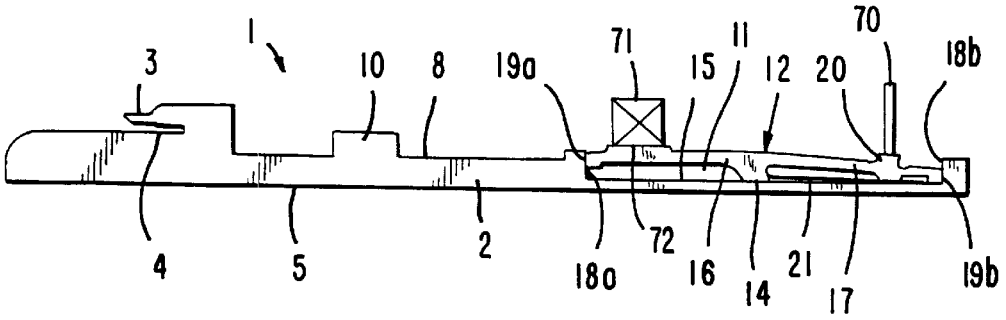
Figure 3:
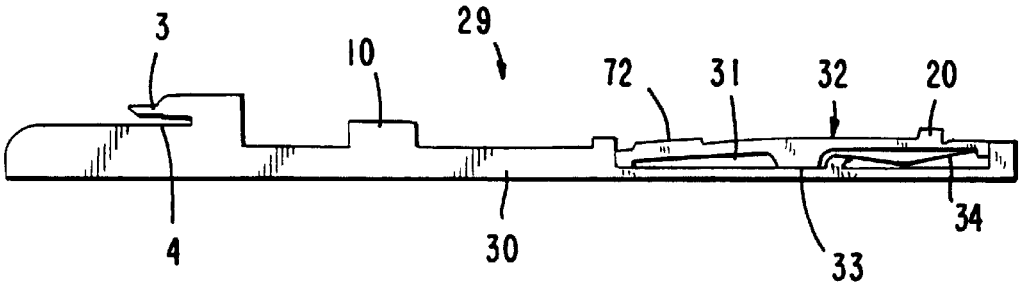
Figure 4:
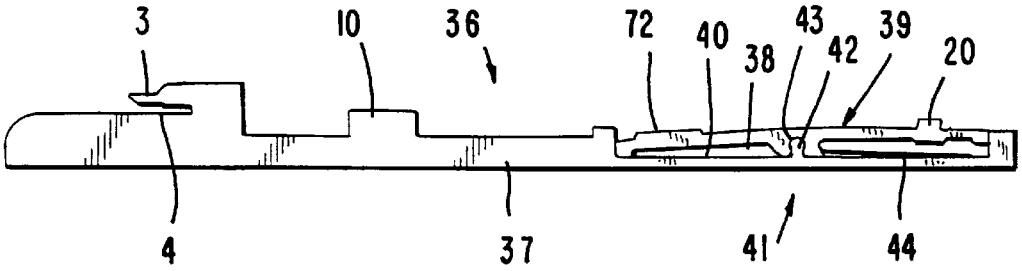
Figure 5:
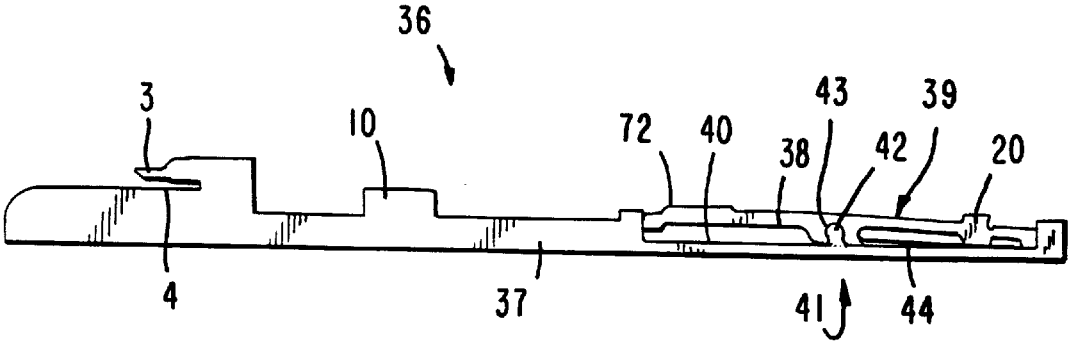
Figure 6:
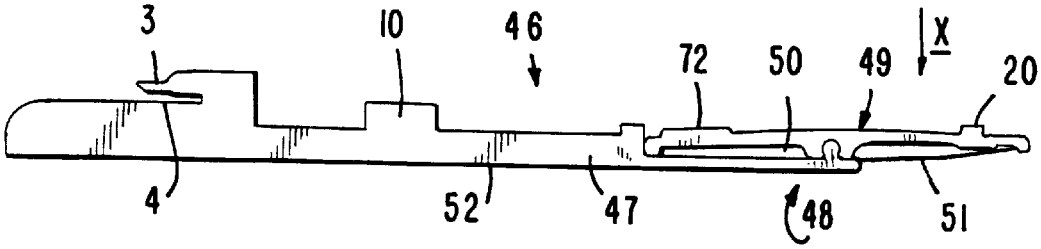
Figure 7:
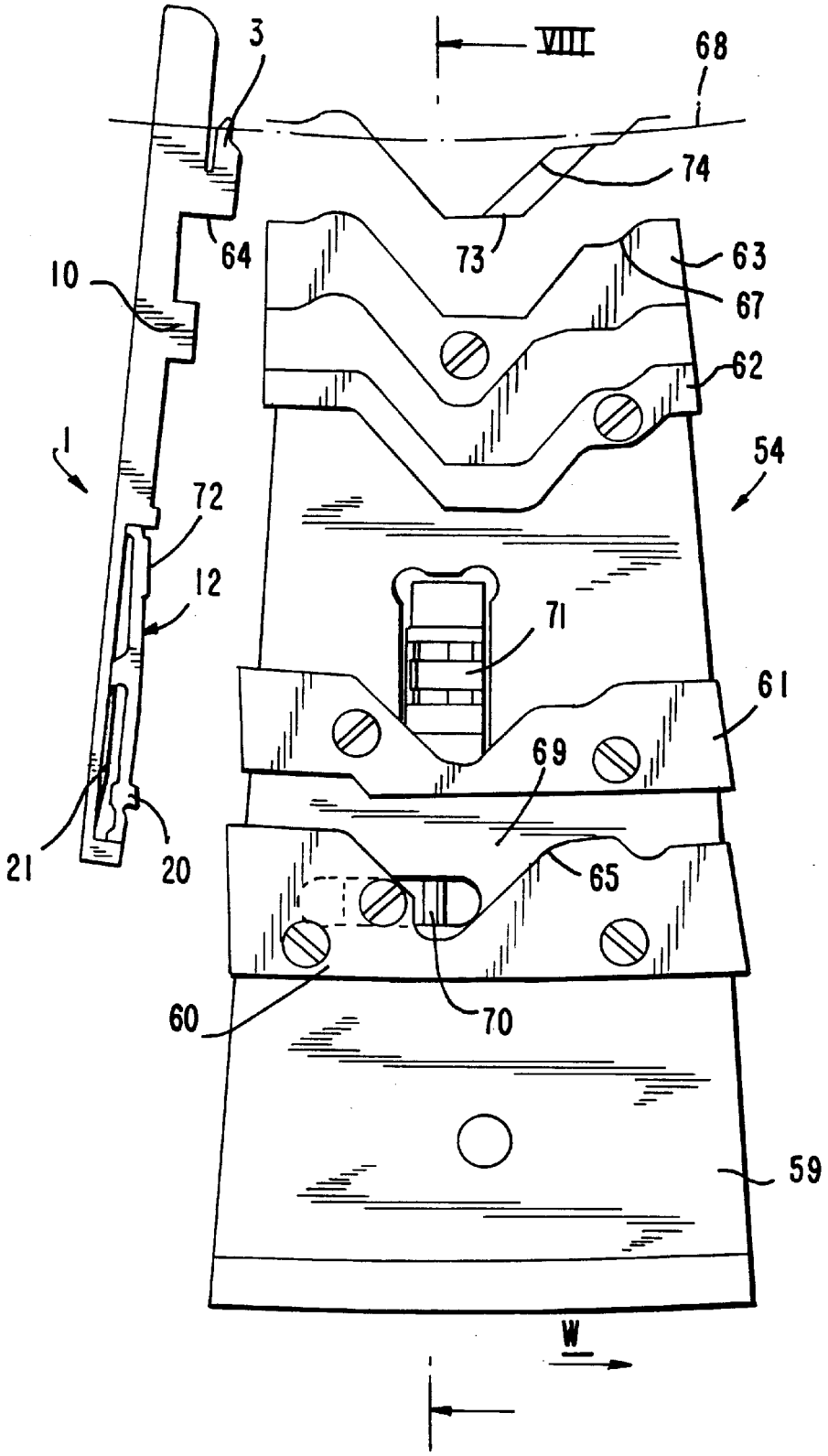

The invention is explained subsequently in greater detail in the embodiments, given by way of example, in conjunction with the accompanying drawings, which show:

FIGS. 1 and 2 side views of a preferred embodiment of a sinker according to the invention for circular knitting machines in different swivel positions of a selection element;

FIG. 3 a view, corresponding to FIG. 1, of a second embodiment of the sinker according to the invention;

FIGS. 4 and 5 views corresponding to FIGS. 1 and 2 of a third embodiment of the sinker according to the invention;

FIG. 6 a view corresponding to FIG. 1 of a fourth embodiment, of the sinker according to the invention;

FIG. 7 the view from below of a system of a cam assembly arrangement for the sinker according to FIGS. 1 and 2; and FIG. 8 a section along the line VIII—VIII of FIG. 7 from which a part of the needle cylinder of a circular knitting machine and a selection device according to the invention can be seen.

According to FIGS. 1 and 2, a sinker 1 according to the invention designed schematically here as a holding-down and a knockover sinker contains a shaft 2, the end of which is provided in the normal manner with a nose 3 and a groove 4. The shaft 2 further contains a back 5, with which said shaft is guided displaceably on the base 6 of a groove of a sinker ring 7 indicated only roughly schematically in FIG. 8, and an upper side 8, which when the shaft is arranged in the sinker ring 7 ends essentially flush with the upper side of the webs 9 forming the grooves (FIG. 8). An operating butt 10, which is fixed rigidly in a front section of the shaft 2 and projects over the front side 8, projects permanently thereby out of the groove.

In a central or lower section of the shaft 2, there is formed a pocket-shaped recess 11 which opens towards the upper side 8 and in which a selection 12 element is arranged. In the embodiment according to FIGS. 1 and 2, the length of the recess 11, measured parallel to the back 5 or to the axis of the shaft 2, is equal to the correspondingly measured length of the selection element 12 so that an axial movement of the selection element 12 relative to the shaft 2 is practically impossible. On the other hand, the selection element 12 within the recess 11 can be swivelled or rotated around an axis which extends perpendicular to the side walls of the shaft 2, i.e. in FIGS. 1 and 2 perpendicular to the plane of the drawing and perpendicular to the shaft axis, as is indicated schematically in FIG. 1 by a double arrow v. The swivelling takes place thereby in the area of a bearing 14 which is arranged in a central part of the recess 11 and which comprises here a supporting surface formed on the rear side of the selection element 12, by means of which supporting surface the selection element 12 is supported on a base 15 of the recess 11. Moreover, the selection element 12 is designed essentially as a two-armed lever which, proceeding from the bearing 14, has a first, forward-projecting lever arm 16 and, on the opposite side of the bearing 14, has a second, downwardly directed lever arm 17. In addition on the one hand the recess 11, and on the other hand the selection element 12 are provided on upper and lower ends with co-operating sliding or guiding surfaces 18*a*, 18*b* and 19*a*, 19*b* which are arranged transversely to the base 15 and formed arc-shaped according to the swivelling radius of the selection element 12.

The selection element 12 has furthermore a controllable raising butt 20. By the designation "controllable" raising butt 20 it is to be understood that, contrary to the operating butt 10, the butt in question can adopt according to choice and depending upon the swivelling state of the selection element 12 preferred positions, namely either a raising position (FIG. 1) in which said butt projects out over the front side 8 of the shaft 2 or a non-raising or pass-through position (FIG. 2) in which said butt is essentially retracted completely behind the front side 8 of the shaft 2 and into the recess 11.

Finally, the sinker 1 according to the invention has a spring 21 which pre-tensions the selection element 12 into one of the two positions according to FIGS. 1 and 2. In the embodiment, the spring 21 is designed as a resilient spring which is fixed roughly in the area of the bearing 14 onto the rear side of the selection element 12, arranged between the base 15 of the recess 11 and the rear side of the lower lever arm 17 and is supported on the base 15 such that said spring holds the lever arm 17 normally swivelled away from the base 15 so that the controllable raising butt 20 projects over the upper side 8 (FIG. 1).

FIG. 3 shows a further embodiment of a sinker 29 according to the invention with a shaft 30 which has a recess 31 in which a selection element 32 is located swivellably by means of a bearing 33. The sinker 29 corresponds to the sinker according to FIGS. 1 and 2 apart from the difference that a spring 34 designed as a resilient spring is attached not to the selection element 32 but closely beneath the bearing 33 to the shaft 30.

FIGS. 4 and 5 show a further embodiment of a sinker 36 according to the invention, corresponding essentially to the embodiment according to FIGS. 1 and 2, with a shaft 37, a recess 38 and a selection element 39. The selection element 39 is here, in contrast to FIGS. 1 and 2, not supported on a base 40 of the recess 38 by means of a bearing but is connected swivellably to the shaft 37 by means of a swivelling bearing 41. The swivelling bearing 41 is formed e.g. by an articulated part 42 attached to the base 40 of the recess 38 in the form of a cylindrical extension or swivelling pin and an articulated part 43 attached to the rear side of the selection element 39 and mounted on the articulated part 42 in the form of a bearing lug. Alternatively the articulated part 43 can be attached to the shaft 37 and the articulated part 42 to the selection element 39. A spring 44 is designed analogously to FIGS. 1 and 2 and fixed closely behind the articulated part 43 onto the selection element 39. Alternatively, the spring 44 could also be fixed onto the shaft 37 analogously to FIG. 3. In addition, the sliding surfaces 18*a*, 18*b* or 19*a*, 19*b* shown in FIGS. 1 and 2 could be omitted in the embodiment according to FIGS. 4 and 5 since the swivelling bearing 41 holds the selection element 39 axially unmoveably to the shaft 37 and prevents it from falling out.

In the embodiment, shown in FIG. 6, of a sinker 46 according to the invention, a shortened shaft 47 is provided which reaches only to closely behind a swivelling bearing 48, designed analogously to FIGS. 4 and 5, for a selection element 49. A recess 50 in the shaft 47 is correspondingly shortened and thereby opens to the rear so that the selection element 49 mounted on the shaft 47 by means of the swivelling bearing 48 corresponding to FIGS. 4 and 5 projects by roughly half freely out of the recess 50. A spring 51 is attached to the shaft 47 analogously to FIG. 3 and designed as an extension of the shaft 47, said extension having a reduced cross-section as compared with shaft 47. In contrast to the other embodiments, the spring 51 is hence not supported in a swivelling position on the base of the recess 50.

FIG. 6 shows the normal position of the spring 51 which abuts with its free end the lower lever arm of the selection element 49 and pre-tensions said lower lever arm forwards in the opposite direction from an arrow x. If the lower member of the selection element 49 is pressed in the direction of the arrow x in FIG. 6 and in the direction of a back 52 of the shaft 47, e.g. with the help of the depressing cam assembly part 70 (FIGS. 1 and 2), then the spring 51 is tensioned analogously to the other embodiments such that, when the selection element 49 is released again, said spring swivels the latter back into the position according to FIG. 6.

Moreover, the arrangement and design of the sinkers 1, 29, 36 and 46 are essentially identical for which reason identical parts are designated throughout with the same reference numbers.

Figure 8:
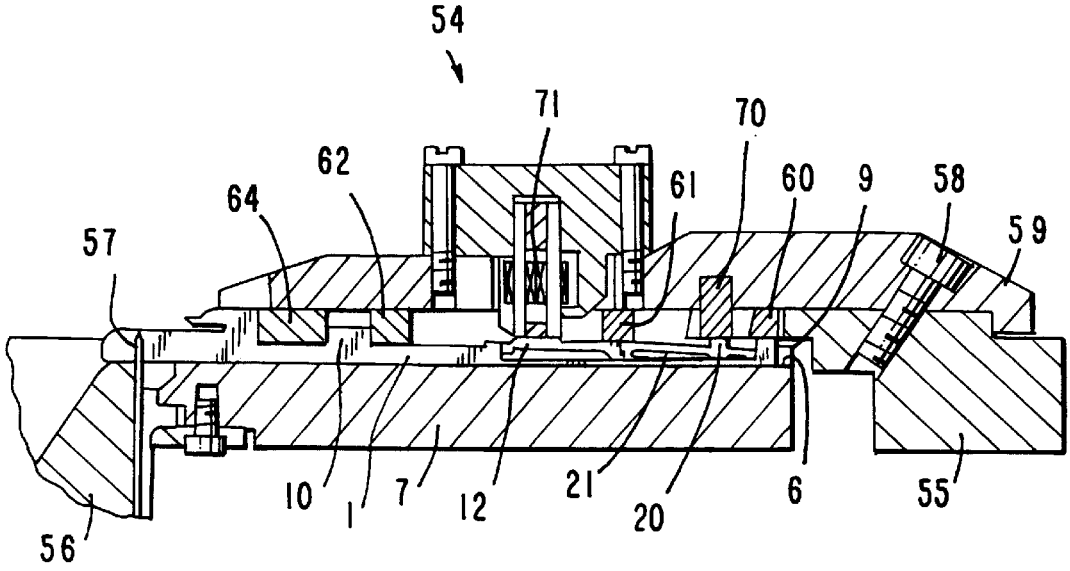

FIGS. 7 and 8 show a selection device containing the sinkers 1 according to FIGS. 1 and 2, it being evident that the same selection device could also contain the sinkers 29, 36 and 46 according to FIGS. 3 to 6.

According to FIGS. 7 and 8 a sinker cam assembly 54 arranged above the sinker ring 7 contains a cam assembly carrier 55 which is arranged stationary in the framework of a circular knitting machine, not shown in greater detail, and above a normal needle cylinder 56 which has cylinder needles 57 which can be moved upwards and downwards in a direction occurring perpendicular to the sinker movement through a not-shown cylinder cam assembly. On the cam assembly carrier 55 there are secured individual segments 59 of the sinker cam assembly 54 by means of screws 58, the segment 59 shown in FIG. 7 forming e.g. a system or a section of a system of a circular knitting machine.

On the lower side of the segment 59, there are arranged in a known manner cam parts 60, 61, 62 and 63 which can act onto the raising butts 20 projecting upwards and the operating butts 10 and also e.g. on operating edges 64 situated between the operating butts 10 and the noses 3 (FIGS. 1 and 7). For this purpose, the cam part 60 has a raising curve 65 for the raising butts 20 and the cam part 63 has an raising curve 67 for the operating edges 64 while the operating butts 10 are guided between the cam parts 62 and 63. It is assumed here that the cylinder needles 57 are arranged on a needle ring 68 and the needle cylinder 56 and the sinker ring 7 rotate in the direction of an arrow w (FIG. 7) relative to the stationary sinker cam assembly 54 although conversely the sinker cam assembly 54 could also rotate in the opposite direction from the arrow w relative to the stationary needle cylinder 56 and the sinker ring 7.

The cam part 60 is provided with a depressing cam part 70, also indicated schematically in FIG. 1, in the region of a selection point 69 which is arranged in the direction of an arrow w shortly before the beginning of the raising curve 65, said depressing cam part operating from above on the raising butts 20 of the passing sinkers 1 and pushing the latter against the force of the springs 21 down into the recess 11.

The cam part 61 has the job essentially of covering the sinkers 1 in the area of the selection point 69 from above and holding them in the recesses 11. Said cam part has moreover a recess in which there is arranged an electromagnetic selection member 71, preferably an electromagnet which can be controlled according to the pattern and which can operate on anchor surfaces 72 provided on the front lever arms 16 of the selection elements 12 and formed essentially by upper surfaces of the selection elements 12 (c.f. FIGS. 1, 2 and 7).

Because of the described pre-tension of the selection element 12, the selection device shown in FIGS. 7 and 8 needs to contain only two essential elements, namely the depressing cam assembly part 70 operating on the controllable raising butts 20 and the selection member 71. A selection of the sinkers 1 in accordance with the pattern can thereby take place as follows: the selection elements 12 upon rotation of the sinker ring 7 proceed firstly into the region of the depressing cam assembly part 70 and from the latter, independently of which position said selection elements adopt, they are swivelled according to FIG. 2 against the force of the associated springs 21 into the position in which the raising butts 20 are sunk into the recesses 11 and hence are arranged outwith the operational area of the raising curve 65. Consequently, the anchor surfaces 72, which are provided on the upper lever arms 16 of the selection elements 12 are swivelled at the same time upwards until said anchor 72 surfaces project a little over the front side 8 of the shafts 2 and are situated near a control magnet of the selection member 71 or come into contact with the latter. If the selection member 71 is fed with electric signals such that the control magnet exerts an attractive adhesive force on the anchor surfaces 72 of the selection elements 12 which is greater than the force of the springs 21 then the raising butts 20 remain even in the further course of the procedure outwith the operational area of the raising curve 65 so that said raising butts move past the latter without being raised by it. The operating edges 64 are raised by the raising curve 67 in this case as a result of which the front ends of the noses 3 of the sinkers 1 are moved along a line 73 (FIG. 7). On the other hand, if the selection magnet 71 is controlled such that its control pole does not adequately attract the anchor surfaces 72, then the selection elements 12 are swivelled back by the associated springs 21 into the position seen in FIG. 1 so that the raising butts 20 run onto the raising curve 65 and the front ends of the noses 3 are moved along a line 74 which later opens into the line 73 along which all of the sinkers 1 then are raised further by means of the raising curve 67. Consequently, for example a not shown plush thread can if desired be placed over the upper edges of the lugs 3 of the sinkers 1 raised along the line 74 or over the knockover edges, situated further down, of the sinkers 1 raised along the line 73.

The described sinkers imply the substantial advantage that the selection elements 12 only need to have one single butt and hence a comparatively simple control is produced with few parts and with parts which have proven effective e.g. with electromagnetic selection devices for knitting needles. In particular, it is not necessary to select the selection elements 12 with the help of hammer needles and/or by applying special depressing cam assembly parts. In addition, the sinkers can be designed to be very short as is desirable for their arrangement in the sinker ring.

The invention is not limited to the described embodiments, given by way of example, which can be changed in many different ways. In particular, the sinker according to the invention could be designed also as a plush sinker or otherwise. Furthermore, the special anchor surface 72 can if required be arranged on the same side as the controllable raising butt 20 since this depends on the type and position of the selection member used in one particular case. Accordingly, it would be possible to arrange the selection elements respectively at the front of the sinker shaft and to fix the rigid butt 10 behind the selection elements i.e. for example in FIG. 1 to the right thereof. Furthermore, the selection element 12, 32 in the embodiments according to FIGS. 1 to 3 could be held in the recess, analogously to FIGS. 4 to 6, in such a way that said selection element can in fact be inserted into said recess or extracted out of said recess from the sides but not being able to be extracted towards the upper side 8. Consequently it is avoided that the selection element is undesirably pushed out of the recess by the force of the spring if it is not held from the top by a cam assembly curve or the like. Furthermore, shapes other than those shown in FIGS. 1 to 6 are conceivable for the selection element. It is further obvious that the selection elements, deviating from the preferred embodiments shown in the drawings, could be mounted also axially displaceably in the recesses. In such a case, it could be also be ensured, by means of additional cam assembly parts operating if necessary on additional butts of the selection elements, that the selection elements adopt the correct axial positions relative to the depressing cam assembly parts 70, the selection members 71 and the raising parts 65 when moving into the selection points. In particular, the springs could thereby operate also on the respectively upper lever arm and/or comprise separate spring elements joined to the selection element or the shaft although the described design makes possible an especially easy production of the shaft resulting from punching and of the selection element including the spring. In conclusion, it is understood that the individual features can be used also in combinations other than those shown and described.

It will be understood that each of the elements described above, or two or more together, may also find a useful application in other types of constructions differing from the types described above.

While the invention has been illustrated and described as embodied in a circular knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adopt it for various applications without omitting features that, from the standpoint of prior art, fairly constitute essential characteristics of the generic or specific aspects of this invention.

What is claimed as new and desired to be protected by Letters Patent is set forth in the appended claims:

1. Sinker for a circular knitting machine comprising: a shaft (2, 30, 37, 47) having an upper side (8), a back (5, 52) and a recess (11, 31, 38, 50) open towards the upper side (8); a selection element (12, 32, 39, 49) having a controllable raising butt (20) and being arranged in said recess (11, 31, 38, 50) at least partly and in such a manner that it is mounted rotatably or swivellably relative to the shaft (2, 30, 37, 47) and can be swivelled into at least a first position, in which the raising butt (20) is retracted behind a front side (8), and a second position in which the raising butt (20) projects upwards over the upper side (8); and a spring (21, 34, 44, 51) pre-tensioning said selection element (12, 32, 39, 49) into one of the two positions.

2. Sinker according to claim 1, wherein said spring (21, 44) is fixed on the selection element (12).

3. Sinker according to claim 1, wherein said spring (34, 51) is fixed on the shaft (30, 47).

4. Sinker according to claim 1, wherein said the recess (11, 31, 38) is configurated to receive the selection element (12, 32, 39) essentially completely.

5. Sinker according to claim 4, wherein said recess (11, 31, 38, 50) has a base (15, 40) and wherein said selection element (12, 32, 39, 49) is provided on a rear side with a bearing (14, 33, 41, 48) supported on said base (15, 40) in the form of a two-armed lever which has one lever arm (16, 17) respectively on opposite sides of the bearing (14, 33, 41, 48).

6. Sinker according to claim 5, wherein said recess (11, 31) and said selection element (12, 32) are provided on upper and lower ends with arc-shaped co-operating sliding surfaces (18*a*, 18*b*; 19*a*, 19*b*).

7. Sinker according to claim 5, wherein said bearing (41, 48) comprises a swivelling bearing which is formed from an articulated part (43) being provided on a rear side of said selection element (39, 49) and from an articulated part (42) being provided on said base (40) of the recess (38, 50), said articulated parts connecting said selection element (39, 49) and said shaft (37, 47) to one another swivellably.

8. Sinker according to claim 5, wherein said spring (21, 34, 44) is arranged between one of the lever arms (16, 17) and said base (15, 40) of the recess (11, 31, 38).

9. Sinker according to claim 7, wherein said recess (50) is open towards the underside of the shaft (47) and the spring (51) is in the form of a lower extension of the shaft (47) and wherein said selection element (49) has a section projecting downwards out of the recess (50) and adjoining the spring (51).

10. Sinker according to claim 1, wherein said selection element (12, 32, 39, 49) is provided will an anchor surface (72) for an electromagnetic selection member (71).

11. Sinker according to claim 10, wherein said anchor surface (72) is arranged on an opposite side of the bearing (14, 33, 41, 48) in comparison to said raising butt (20).

12. Sinker according to claim 1 and further having a rigid operating butt (10).

13. Sinker according to claim 1, wherein said selection element (12, 32, 39, 49) is arranged axially in an essentially undisplaceable manner relative to said shaft (2, 30, 37, 47).

14. Selection device on a circular knitting machine, comprising: a sinker ring (7); sinkers each having an upper side (8), a back (5, 52), a recess (11, 31, 38, 50) open towards said upper side (8), a selection element (12, 32, 39, 49) having a controllable raising butt (20) being arranged in said recess (11, 31, 38, 50) at least partly and in such a manner that it is mounted rotatablly or swivellably relative to a shaft (2, 30, 37, 47) and can be swivelled into at least a first position, in which the raising butt (20) is retracted behind a front side (8), and a second position in which the raising butt (20) projects upwards over the upper side (8), and a spring (21, 34, 44, 51) pre-tensioning said selection element (12, 32, 39, 49) into one of the two positions, said sinkers (1, 29, 36, 46) being mounted displaceably in said sinker ring (7); a sinker cam assembly (54) having cam parts (60 to 63) operating on the raising butts (10, 20) of the sinkers (1, 29, 36, 46) and an electromagnetic selection member (71) which is arranged in the area of a selection point (69) to distribute the sinkers (1, 29, 36, 46) onto different paths (73, 74) in accordance with a pattern, wherein said sinker cam assembly (54) has a depressing cam part (70) for swivelling said selection elements (12, 32, 39, 49) into a position for pre-tensioning the springs (21, 34, 44, 51) and as a result for making anchor surfaces (72) of said selection elements (12, 32, 39, 49) approach said selection member (71).

* * * * *